US007297078B2

(12) United States Patent
Libonati

(10) Patent No.: US 7,297,078 B2
(45) Date of Patent: Nov. 20, 2007

(54) BALL SPORTS TRAINING AID

(76) Inventor: Michael R. Libonati, 22733 Miranda St., Woodland Hills, CA (US) 91367

( * ) Notice: Subject to any disclaimer, the term of this patent is extended or adjusted under 35 U.S.C. 154(b) by 24 days.

(21) Appl. No.: 11/394,328

(22) Filed: Mar. 28, 2006

(65) Prior Publication Data

US 2006/0223656 A1 Oct. 5, 2006

Related U.S. Application Data

(60) Provisional application No. 60/667,712, filed on Apr. 1, 2005.

(51) Int. Cl.
*A63B 69/00* (2006.01)

(52) U.S. Cl. ..... 473/457; 473/422; 473/437

(58) Field of Classification Search ..... 473/422, 473/437, 457, 555–568, 519, 521, 523, 549, 473/552, 231, 234
See application file for complete search history.

(56) References Cited

U.S. PATENT DOCUMENTS

| | | | | |
|---|---|---|---|---|
| 3,136,546 | A | 6/1964 | Connolly | |
| 3,137,504 | A * | 6/1964 | Zordan et al. | 473/457 |
| 3,173,326 | A | 3/1965 | Saacson | |
| 3,173,688 | A | 3/1965 | Green | |
| 3,578,801 | A * | 5/1971 | Piazza | 473/457 |
| 4,027,886 | A | 6/1977 | Katsube | |
| 4,330,121 | A * | 5/1982 | McCafferty | 473/228 |
| 4,634,121 | A * | 1/1987 | Sasaki | 473/457 |
| 4,898,386 | A | 2/1990 | Anderson | |
| 5,024,436 | A | 6/1991 | Vento | |
| 5,133,551 | A | 7/1992 | Handy et al. | |
| 5,360,209 | A * | 11/1994 | Mollica | 473/457 |
| 5,577,966 | A * | 11/1996 | Duran | 473/234 |
| 5,590,875 | A | 1/1997 | Young | |
| 5,830,091 | A | 11/1998 | Romanick | |
| 6,024,660 | A | 2/2000 | Romanick | |
| 6,254,498 | B1 | 7/2001 | Tyner | |
| 6,296,582 | B1 | 10/2001 | Minniear | |
| 6,338,687 | B1 | 1/2002 | Thompson | |
| D457,929 | S | 5/2002 | Ciesar et al. | |
| D480,122 | S | 9/2003 | Ciesar et al. | |
| 6,758,761 | B2 | 7/2004 | Katsuya | |
| 6,949,036 | B2 * | 9/2005 | Ciesar et al. | 473/457 |
| 7,147,580 | B2 * | 12/2006 | Nutter et al. | 473/457 |
| 2003/0144089 | A1 | 7/2003 | Ryan | |
| 2004/0048696 | A1 | 3/2004 | Ciesar et al. | |

* cited by examiner

*Primary Examiner*—Mitra Aryanpour
(74) *Attorney, Agent, or Firm*—Ocean Law; Paul D. Chancellor

(57) ABSTRACT

A ball sports training aid includes a shaft and a slidably engaged replica sports ball assembly with an integral damper that is actuated when a player swings the shaft. Integral swing diagnostics means indicate correct batting, pitching and throwing techniques.

8 Claims, 4 Drawing Sheets

BALL SPORTS TRAINING AID

This application claim priority from Provisional Application 60/667,712 filed Apr. 1, 2005.

BACKGROUND OF THE INVENTION

1. Field of the Invention

The present invention relates to the mechanical arts. In particular, the invention relates to a training aid used by ball sports players to learn and/or improve batting, throwing, and pitching techniques.

2. Discussion of the Related Art

Ball sports players have trained with the implements of their sports for centuries. For example, since the 1850's baseball players have used the wooden bats of their sport to practice batting balls thrown by a pitcher. Since the 1960's there has also been widespread use of pitching machines that emulate the pitcher. Similarly, pitchers and throwers have practiced by throwing a ball to a second person who returns the ball after each pitch.

Ball player training therefore frequently relies the availability of a second person who pitches balls in the case of batter training, or returns balls in the case of pitcher and thrower training. In addition, either the second person or a third person will be required to observe batting or throwing technique that is unobservable to the player, that the player is unable to analyze for diagnostic purposes, or both. The opportunities for ball player training are therefore limited by the availability of a second person and the effectiveness of ball player training is limited by the availability of a person who provides diagnostic feedback to the player.

Others have invented training aids for baseball batters that are aimed at solving some of these problems. For example, U.S. Pat. App. Publ. 2002/0055402 discloses a training bat having a handle, a shaft, and a graspable cylindrical sliding member mounted between stops on the training bat. When swung, the sliding member strikes one of the stops and produces a sound. But, this training bat fails to provide sufficient visual signals to the player, sufficient swing diagnostics, or a solution to the shock and shock related swing distortion and wear problems associated with the repetitive collisions between sliding and stationary parts.

Others have also invented training aids for throwing that are aimed at solving some of these problems. For example, U.S. Pat. No. 6,024,660 discloses a training aid for throwing sports balls having a hollow shaft with a hand grip affixed at one end. A ring encircling or a dowel within the shaft is free to move in response to a throw and to collide with a stop to produce a sound. But, this training thrower fails to provide ball release training and diagnostics nor does it provide a solution to the shock and shock related swing distortion and wear problems associated with the repetitive collisions of the ring or dowel with a stop.

Therefore, there remains a need for ball sports training aids that provide sufficient visual signals and swing diagnostics to players in training. There remains a further need for ball sports training aids that provide ball release training and diagnostics for throwers. And, there remains a still further need for a solution to the shock and shock related swing distortion and wear problems associated with the repetitive collisions of contacting parts.

SUMMARY OF THE INVENTION

The present invention discloses a training aid for players of ball sports. In particular, the training aid is useful for teaching baseball and softball players proper swing mechanics. In an embodiment, the training aid has a relatively long shaft and is used for training batters. In another embodiment the training aid has a relatively short shaft and is used for training pitchers and throwers. These embodiments employ a ball assembly that slides along a distal portion of the shaft during a swing or a throw. The travel of the ball assembly is limited by a first retainer located near a handle end of the shaft and a second retainer located near a free-end of the shaft.

The training aids provide visible and audible swing quality signals to the player. The use of a regulation or replica sports ball provides the player with a visual indication of correct swing timing. In addition, a distinct snap-like sound occurs when the ball assembly impacts the free-end retainer. The sound triggers the memory at impact and allows the user to see the correct timing of the swing. This combined proprioceptive input enhances the player's awareness of hand-eye coordination and timing while conditioning and training the specific muscles used for batting, pitching, and throwing.

It is a further advantage of the training aid that a damper is incorporated in the ball assembly to reduce the mechanical shock when the ball assembly collides with the free-end retainer. Coulomb damping resulting from friction between the ball and a damper tube inserted in the ball dissipates the energy of the collision resolving the shock and shock related swing distortion and wear problems associated with the repetitive collisions of contacting parts.

BRIEF DESCRIPTION OF THE DRAWINGS

The present invention is described with reference to the accompanying figures. In the figures, like reference numbers indicate identical or functionally similar elements. The accompanying figures, which are incorporated herein and form part of the specification, illustrate the present invention and, together with the description, further serve to explain the principles of the invention and to enable a person skilled in the relevant art to make and use the invention.

DETAILED DESCRIPTION OF THE INVENTION

Figure 1A:
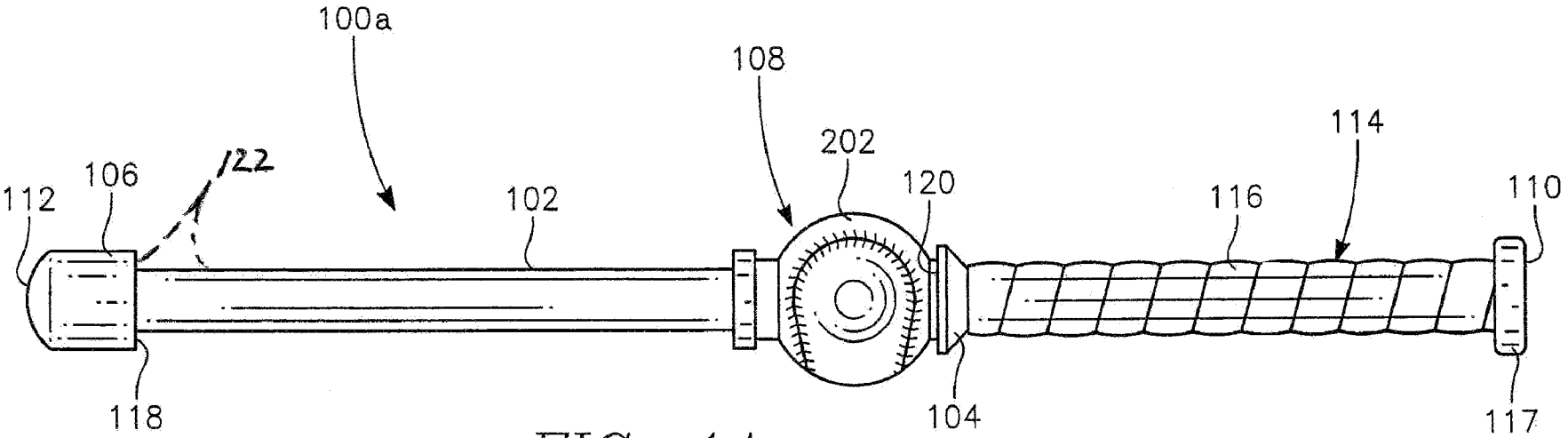
FIG. 1*a* shows a perspective view of the pre-swing configuration of a batter's training aid of the present invention.
Figure 1B:
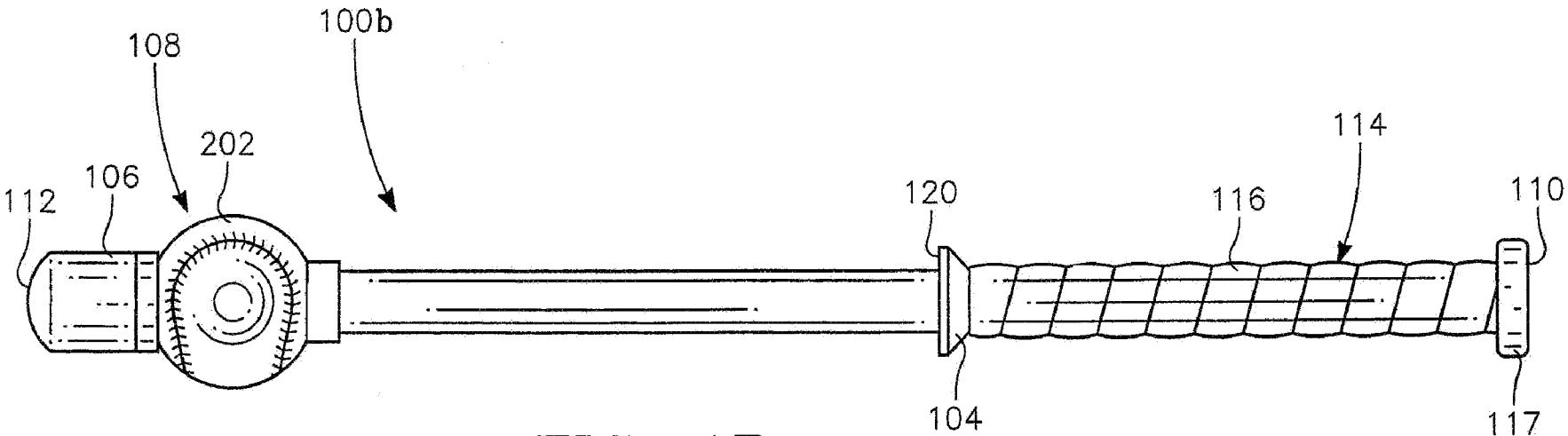
FIG. 1*b* shows a perspective view of the post-swing configuration of the batter's training aid depicted in FIG. 1*a*.

FIGS. 1*a* and 1*b* show a training bat embodiment 100*a*, 100*b* of the present invention. The invention includes a shaft 102, a first retainer 104, a second retainer 106, and a replica sports ball assembly 108.

The shaft 102 of the training bat 100 has a handle end 110 and a free-end 112. A handle section of the shaft 114 adjacent to the handle end provides space for the batter to hold the bat with two hands. While the batter may hold the bare shaft, some embodiments provide a grip 116 attached to the handle section for improving the batter's control of the bat. A knob 117 is preferably located at the handle end of the shaft to prevent the player's accidental release of the bat, In an embodiment, the shaft is a metallic tube. In some the embodiments the weight of the training bat and its weight distribution are similar to that of a regulation bat for baseball or for softball.

The ball assembly 108 is slidably engaged with the shaft 102. The first ball assembly retainer 104 is located between the handle section 114 and the free-end 112 of the bat 100. A second ball assembly retainer 106 is located near the free-end. The two retainers limit the sliding motion of the ball assembly to a region of the shaft located between the two retainers.

In an embodiment, the location of the first retainer 104 may be adjusted to select the length of travel of the ball assembly 108 during a swing and in some embodiments the second retainer 106 is replaceable for adjusting the weight at the free-end of the shaft.

Figure 2A:
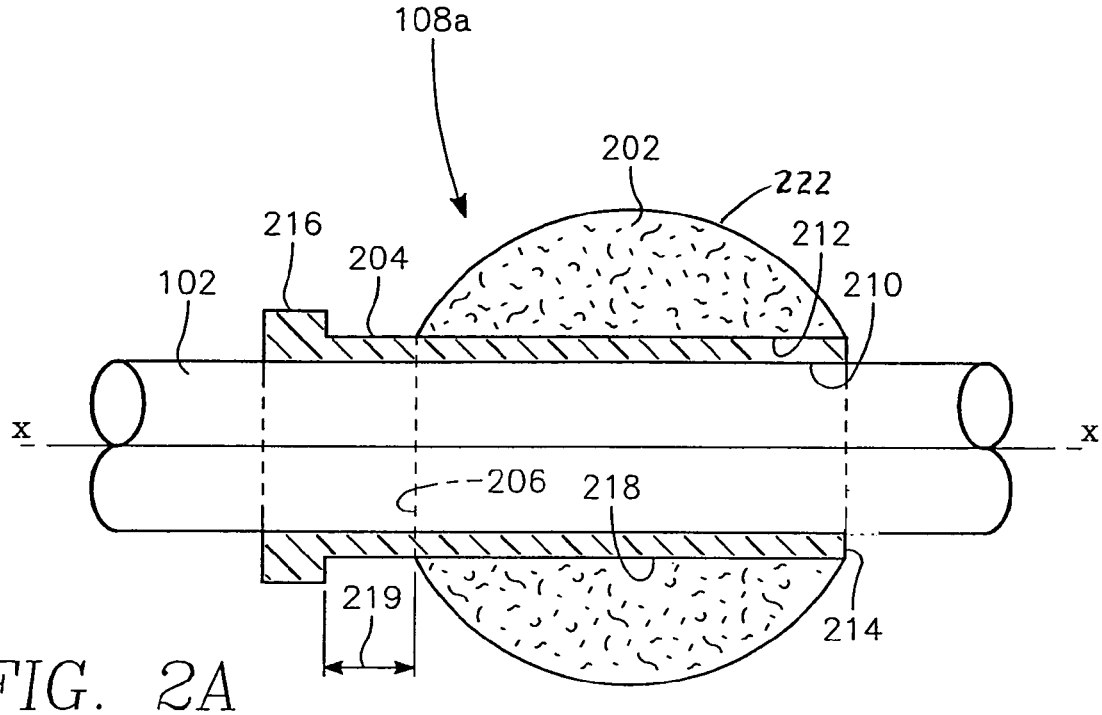
FIG. 2*a* shows a side view of the pre-swing configuration of a replica ball assembly of the batter's training aid depicted in FIG. 1*a*.
Figure 2B:
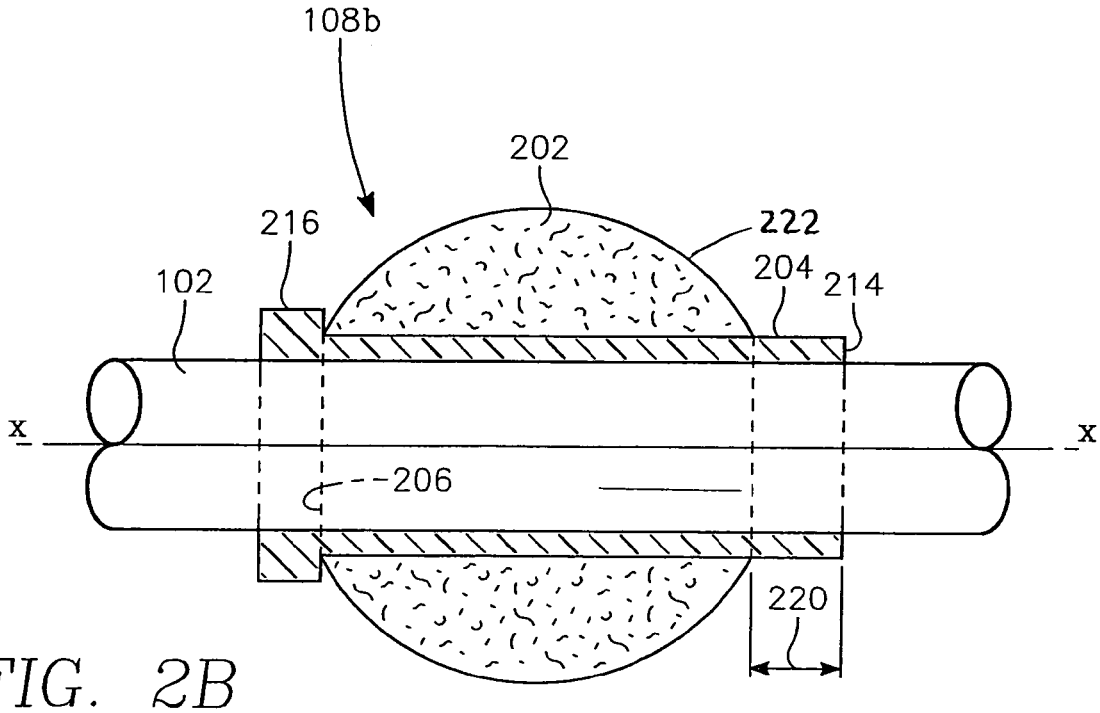
FIG. 2*b* shows a side view of the post-swing configuration of a replica ball assembly of the batter's training aid depicted in FIG. 1*a*.

FIGS. 2*a* and 2*b* show the parts of the ball assembly 108*a*, 108*b*. The ball assembly includes a light-weight replica sports ball 202 such as a replica sports ball such as a replica baseball or a replica softball and a damper tube 204 which is inserted in a hole in the sports ball.

The replica sports ball 202 has a through hole 206. In a preferred embodiment, the hole has a substantially constant cross-sectional area defining a geometric centerline that is about coextensive with an axis x-x passing through the center of the ball. In some embodiments, the replica sports ball is a regulation baseball or softball with a through hole. And, in some embodiments the sports ball is made from one or more materials including a light weight core material such as cork (density of 100-300 kilograms/cubic-meter).

The damper tube has a flanged end 216, a butt end 214, and an inner surface 210. The butt end is for striking a cup shaped surface 120 of the first retainer 104. The flanged end is for striking an annular surface 118 of the second retainer 106 and for making an audible sound. In some embodiments one or both ends of the damper tube are butt ends and in some embodiments one or both ends of the damper tube are flanged ends. The damper tube is preferably made from a plastic material such as polyethylene.

The outer surface of the damper tube 218 is in sliding contact or dampingly engaged with the side walls of the through hole 212 since the fit between the outer surface of the damper tube and the side walls of the through hole is an interference fit (gap shown in FIGS. 2*a* and 2*b* is for clarity). The amount of interference, material, and material surface properties determine the force required to overcome the related frictional forces tending to prevent the replica sports ball 202 from sliding along the damper tube 204. In an embodiment, the damper tube and the through hole 206 have generally circular cross-sections.

In another embodiment, a suitable resilient material such as textiles including felts and piled materials or an elastomer including foams is interposed between the outer surface of the damper tube 218 and the side walls of the through hole 206. Preferably, the resilient material is attached to the side walls of the through hole such that the damper tube 204 slides with respect to an adjacent surface of the resilient material which rubs against it. In an embodiment the resilient material is an elastomer such as an open-cell foam.

In an embodiment, an electronic signaling device 122 is mounted within the shaft 102 and/or within the second retainer 106 (as shown). The signaling device emits an audible sound in response to the flanged end of the damper tube 216 reaching the second retainer 106. In an embodiment, an electronic sensing and signaling device provides swing diagnostics information including swing dynamics based on data acquired from sensors during the swing. Sensors used for this purpose include one or more of accelerometers for sensing relative motion and radio wave type locators including global positioning systems (GPS) and similar systems for obtaining position based on trilateration. Diagnostics are reported to the player and/or other persons using one or more of lighted indications and audible sounds emanating from the training aid and remote printers or video displays. In some embodiments the swing diagnostics are reported by a speech generator in signal communication with the electronic signaling device.

In operation, the training bat embodiment of the invention 100*a*, 100*b* is used to train and/or improve a batter's swing. The batter handles the training bat in a manner that is similar to the way in which a regulation bat would be handled by a player. When a swing is made the ball assembly 108 moves from its rest against the first retainer 104, along the shaft 102, and impacts the second retainer 106 with an audible snap-like sound.

When the ball assembly 108 is at rest against the first retainer 104, the butt end of the damper tube 214 is about flush with the outer surface of the replica sports ball 222 and the flanged end of the damper tube 216 has its maximum projection 219 from the outer surface of the replica sports ball as shown in FIG. 2*a*. When ball assembly 108 nears the free-end of the training bat 112, the flanged end of the damper tube strikes the annular surface of the second retainer 118. The mechanical shock of this collision and the associated undesirable wear of the colliding parts is reduced by Coulomb or frictional damping when the ball drags along the outer surface of the damper tube 208 and absorbs a portion of the energy/shock of the collision. Where electronic signaling devices 122 are mounted in the second retainer, the Coulomb damping of the ball assembly plays another important role in preserving the life of these electronic devices by reducing the mechanical shocks experienced during training.

When the ball assembly 108 comes to rest against the second retainer, 106, the butt end of the damper tube 214 has its maximum projection 220 from the outer surface of the replica sports ball 222 and the flanged end of the damper tube 216 is about flush with the outer surface of the replica sports ball as shown in FIG. 2*b*. In preparation for another practice swing, the batter grasps the replica sports ball 202 and pulls the ball assembly 108 against the first retainer. This action forces the damper tube back through the replica sports ball such that the maximum projection of the flanged end of the damper tube 219 is restored.

In an embodiment, preparation for another swing requires only that the batter raise the training bat 100 to his shoulder to restore the damper tube's maximum projection 219. Here, the act of raising the bat causes the ball assembly 108 to slide back toward the bat's handle end 114 causing the butt end of the damper tube 214 to strike the first retainer 104. This collision causes the replica sports ball 202 to slide relative to the damper tube 204 until the butt end of the damper tube is about flush with the outer surface 222 of the replica sports ball 202.

The training bat provides a batter with at least three feedback signals from which to judge the quality of his swing. First, the "feel" of the swing informs the batter about the swing. Since the training bat uses a replica sports ball 202 rather than a weight, neither the swing dynamics nor the related player sensations are distorted when the replica sports ball slides along the length of the shaft 102 during the swing. Second, the replica sports ball is easily observed by the batter as the free-end of the training bat 112 passes in front of the batter. A correct swing is one in which the batter observes the replica sports ball reaching the second retainer of the bat just as the bat passes over a batter's plate. Third, the sound of the damper tube flange 212 striking the annular surface of the second retainer 118 provides a timed, audible indication of when the bat should be passing over the plate.

Figure 3A:
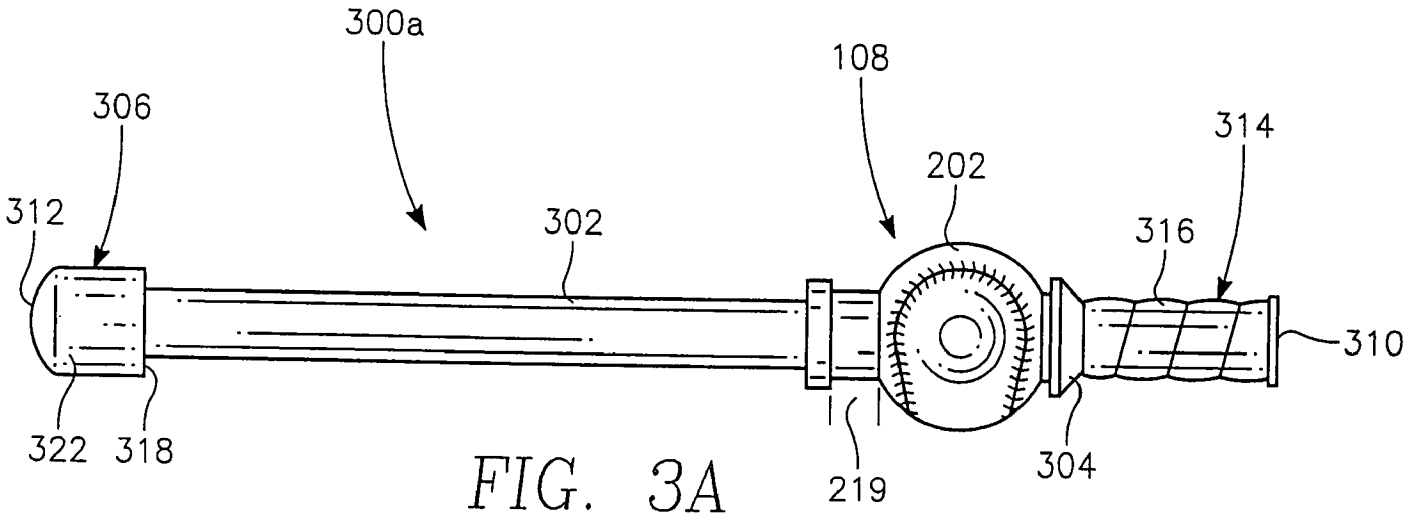
FIG. 3*a* shows a perspective view of the pre-throw configuration of a pitcher's training aid of the present invention.
Figure 3B:
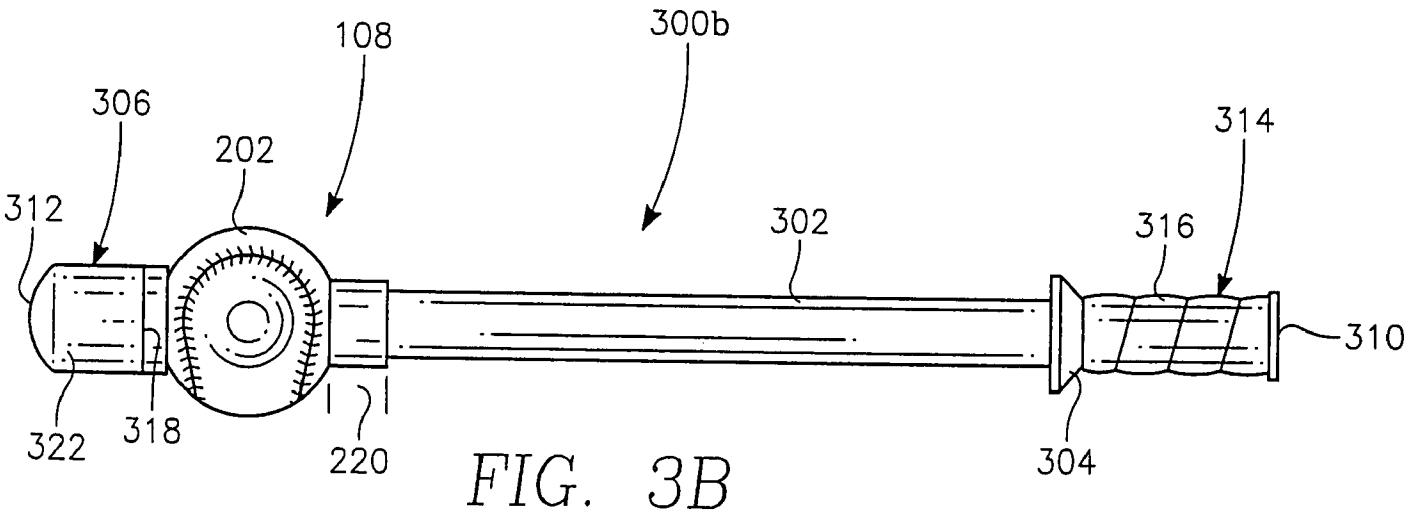
FIG. 3*b* shows a perspective view of the post-throw configuration of a pitcher's training aid of the present invention.

FIGS. 3*a* and 3*b* show a training thrower embodiment 300*a*, 300*b* of the present invention. The invention includes a shaft 302, a first retainer 304, a second retainer 306, and a replica sports ball assembly 108. Unless otherwise indicated, a reference to a player who is a pitcher also includes a player who is a thrower and vice versa.

The shaft 302 of the training thrower 300 has a handle end 310 and a free-end 312. A handle section of the shaft 314 adjacent to the handle end provides space for a pitcher to hold the training thrower with one hand. While the pitcher may hold the bare shaft, some embodiments provide a grip 316 attached to the handle section for improving the pitcher's control of the thrower.

The ball assembly 108 is slidably engaged with the shaft 302. A first ball assembly retainer 304 is located between the handle section 314 and the free-end 312 of the thrower 300. A second ball assembly retainer 306 is located near the free-end. The two retainers limit the sliding motion of the ball assembly to a region of the shaft located between the two retainers.

In operation, the training thrower embodiment of the invention 300*a*, 300*b* is used to train and/or improve a pitcher's throw. The pitcher handles the training thrower in a manner that is similar to the way in which a regulation sports ball would be handled and practices throws. In particular, with one hand the pitcher clasps the handle section of the training thrower 314 against his palm using his small and index fingers. With the remaining fingers, the pitcher grasps the replica sports ball 202. During practice throws, the pitcher releases the replica sports ball but not the handle. Once released, the ball assembly 108 moves from its rest against the first retainer 304, along the shaft 302, and impacts the second retainer 106 with an audible snap-like sound.

As in the case of the training bat 100 described above, after each throw the damper tube 204 is reset relative to the sports ball 202 when the pitcher grasps the replica sports ball 202 and pulls the ball assembly 108 against the first retainer 304 or in another embodiment when the act of raising the thrower 300 causes the ball assembly to collide with the first retainer 104 in a manner similar to that of the training bat discussed above. In addition, during throws the pitcher receives feedback signals from the thrower similar to those provided by the bat. These signals include the "feel" of the throw, the visible location of the replica sports ball on the shaft 302, and the sound of the ball assembly striking the second retainer 318. In some embodiments, electronic signaling and/or diagnostic devices 322 similar to those used in the bat may be incorporated in the thrower.

Figure 4:
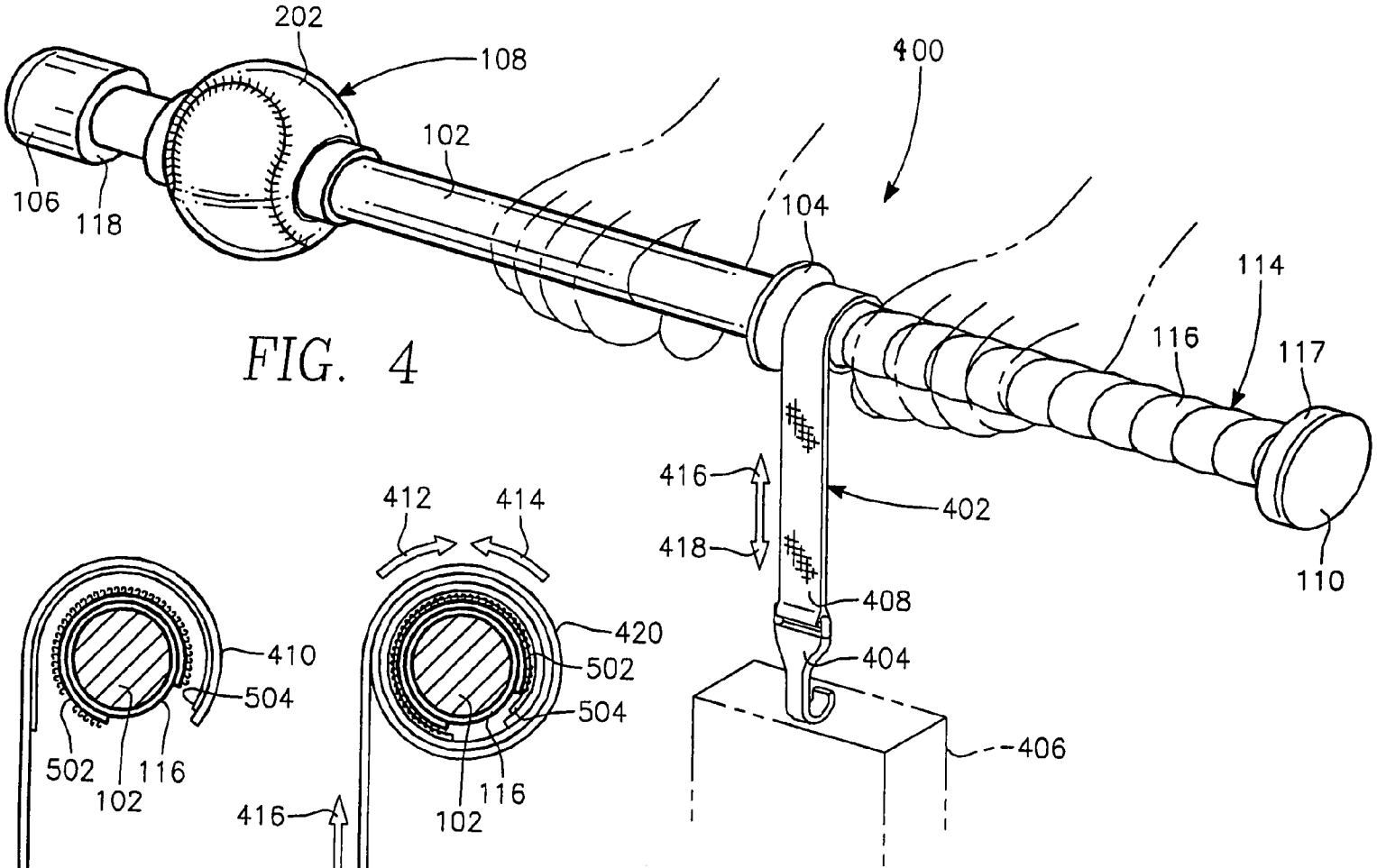
FIG. 4 shows a perspective view of a workout assembly incorporating the batter's training aid depicted in FIG. 1*a*.

FIG. 4 shows a workout assembly 400. The workout assembly includes a strap 402 interconnecting a weight 406 and the training bat 100. The strap is made of a flexible material including one or more of a fabric, plastic, or similar material. In an embodiment the strap is woven and includes nylon. The weight is made from a metallic or non-metallic material suitable for achieving the desired mass. In some embodiments the weight has a re-sealable cavity for receiving shot, sand, water, or another material to vary its mass.

Affixed near a first end of the strap 408 is a first connection 404 for engaging the weight 406. In an embodiment, the first connection includes a means for releasably engaging the weight such as a spring clip (as shown). Affixed near a second end of the strap 410 is a second connection 504 (see also FIG. 5) for engaging the grip 116 (as shown) or shaft 102 of the training bat. In an embodiment, the second connection includes a hook and loop fastener wherein a first hook and loop fastener portion 504 is attached to the strap and a mating hook and loop fastener portion 502 encircles the grip 116 near the first retainer 104.

Figure 5:
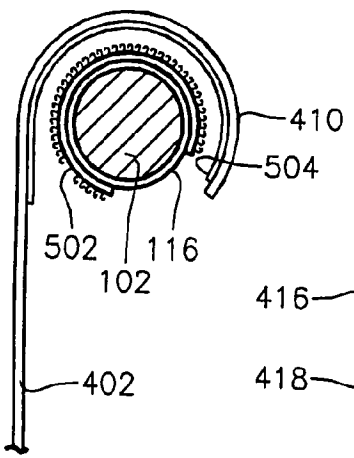
FIG. 5 shows an end view of the unassembled workout assembly of FIG. 4.

FIG. 5 shows a cross-sectional view 500 of the strap 402 and the training bat 100 prior to attachment of the strap to the training bat. Where a hook and loop fastener system is used, bringing the first hook and loop fastener portion of the strap 504 into contact with the mating hook and loop fastener portion of the training bat 502 releasably affixes the strap to the training bat. Attaching the weight 406 to the first end of the strap with the spring clip 404 or another suitable means completes assembly.

Figure 6:
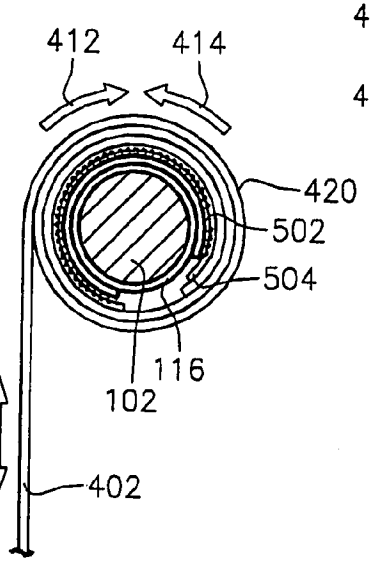
FIG. 6 shows an end view of the assembled workout assembly of FIG. 4.

FIG. 6 shows a cross-sectional view 600 of the strap 402 and the training bat 100 during use. Here, the workout assembly 400 provides weight training of an athlete's hands, wrists, and forearms. This weight training is accomplished when the athlete grasps the training bat with both hands and rotates the training bat's shaft 102 in alternate directions. When rotated in a first direction 412, the weight is raised 416 as the strap 402 is spooled 420 onto the training bat. When rotated in a second direction 414, the weight is lowered 418 as the strap is de-spooled 420 from the training bat.

As a person of ordinary skill in the art will recognize, the length of the strap 402 can be varied to suit the physical attributes of the athlete. In addition, the mass of the weight 406 can be varied to suit the desired training regime.

While various embodiments of the present invention have been described above, it should be understood that they have been presented by way of example only, and not limitation. It will be understood by those skilled in the art that various changes in form and details can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A training aid for throwers comprising:

an elongated shaft having a handle end for engaging a thrower's hand and a free end;

a damper tube slidably engaged with a distal portion of the shaft and disposed between a first and a second retainer located on the shaft;

a replica sports ball dampingly engaged with the damper tube;

relative motion between the ball and the damper tube for providing Coulomb damping when the ball but not the handle end is released during a throw and the damper tube collides with the second retainer;

a means for providing swing diagnostics; and, a means for exercising a thrower's throwing muscles.

2. A training aid for batters comprising:

an elongated shaft having a handle end for engaging a batter's two hands and a free end;

a damper tube slidably engaged with the shaft and disposed between a first and a second retainers located on the shaft;

a replica sports ball dampingly engaged with the damper tube;

the ball and the damper tube operative to move relative to each other when the shaft is swung and the damper tube collides with the second retainer;

the ball and the damper tube operative to dissipate kinetic energy of the ball and the damper tube when relative motion between the ball and the damper tube causes coulomb damping to occur;

a means for providing swing diagnostics; and, a means for exercising a batter's batting muscles.

3. The device of claim 2 wherein the length of the damper tube in relation to the diameter of the replica sports ball is increased to increase coulomb damping and decreased to decrease coulomb damping.

4. The device of claim 2 wherein motion of the replica sports ball between the retainers provides visual swing signals to the player and collisions of the damper tube with the second retainer provide audible swing signals to the player.

5. The device of claim 4 wherein swing diagnostics means coupled to the shaft produce an audible electronic sound at the time the damper tube collides with the second retainer.

6. The device of claim 5 wherein the swing diagnostics means acquires swing data utilizing trilateration and analyzes the data to provide an indication of swing quality.

7. The device of claim 2 wherein the means for exercising a batter's batting muscles includes:

a strap having a first end affixed to the shaft and a second end affixed to a weight; and, the shaft operable to raise the weight when the strap is spooled onto the shaft and to lower the weight when the strap is de-spooled from the shaft in response to shaft rotations in respective first and second directions.

8. The device of claim 7 wherein the weight has a re-sealable cavity for receiving shot, sand or water for varying the mass of the weight to suit a particular athlete and training regime.

* * * * *